US006398665B1

(12) United States Patent
Antonious

(10) Patent No.: US 6,398,665 B1
(45) Date of Patent: Jun. 4, 2002

(54) GOLF CLUB WITH UNIQUE BALL STRIKING FACE CONFIGURATION

(76) Inventor: Anthony J. Antonious, 7738 Calle Facil, Sarasota, FL (US) 34238

( * ) Notice: Subject to any disclaimer, the term of this patent is extended or adjusted under 35 U.S.C. 154(b) by 0 days.

(21) Appl. No.: 09/511,161

(22) Filed: Feb. 23, 2000

(51) Int. Cl.[7] ..... A63B 53/04
(52) U.S. Cl. ..... 473/330; 473/331
(58) Field of Search ..... 473/324, 330, 473/331, 290, 131, 253, 254; D21/747, 750, 751, 759

(56) References Cited

U.S. PATENT DOCUMENTS

| | | | | |
|---|---|---|---|---|
| 1,535,670 | A | * | 4/1925 | Kidd |
| 1,536,616 | A | * | 5/1925 | Manning |
| 1,927,083 | A | * | 9/1933 | Davis |
| D101,108 | S | * | 9/1936 | Ellingham |
| D179,817 | S | * | 3/1957 | Penna |
| D179,818 | S | * | 3/1957 | Penna |
| D190,034 | S | * | 4/1961 | Penna |
| D190,430 | S | * | 5/1961 | Penna |
| D192,366 | S | * | 3/1962 | Penna |
| D193,098 | S | * | 6/1962 | Davis |
| D209,299 | S | * | 11/1967 | Long |
| 4,077,632 | A | * | 3/1978 | Taylor |
| 4,753,440 | A | * | 6/1988 | Chorne |
| 4,792,140 | A | * | 12/1988 | Yamaguchi |
| D303,415 | S | * | 9/1989 | Chorne |
| 5,082,278 | A | * | 1/1992 | Hsien |
| D345,191 | S | * | 3/1994 | Iinuma |
| 5,505,450 | A | * | 4/1996 | Stuff |
| 5,709,617 | A | * | 1/1998 | Nishimura |
| D417,712 | S | * | 12/1999 | Antonious |
| D426,605 | S | * | 6/2000 | Antonious |
| D428,458 | S | * | 7/2000 | Antonious |
| D429,786 | S | * | 8/2000 | Antonious |
| D430,914 | S | * | 9/2000 | Antonious |
| D431,853 | S | * | 10/2000 | Antonious |
| D433,087 | S | * | 10/2000 | Antonious |
| D434,096 | S | * | 11/2000 | Antonious |
| 6,224,497 | B1 | * | 5/2001 | Antonious |

FOREIGN PATENT DOCUMENTS

| | | | | |
|---|---|---|---|---|
| GB | 25564 | * | 12/1905 | ..... 273/175 |

* cited by examiner

*Primary Examiner*—Sebastiano Passaniti
(74) *Attorney, Agent, or Firm*—Welsh & Flaxman LLC

(57) ABSTRACT

Iron and wood type golf club heads having an improved ball striking face configuration including various combinations of punch marks and grooves on the ball striking face.

21 Claims, 5 Drawing Sheets

GOLF CLUB WITH UNIQUE BALL STRIKING FACE CONFIGURATION

BACKGROUND OF THE INVENTION

The present invention relates to golf club heads in particular to club heads having ball striking faces with improved configurations.

Most iron wood type club heads with vertical and/or angular grooves are known in the prior art. These arrangements have been marketed with limited success. Recently, manufacturers have introduced iron club faces which provide courser finishes. Examples are face inserts that include diamond particles or other comparable materials that are bonded or fused to the club face. The purpose is to provide greater traction between the golf club face and golf ball creating greater backspin resulting in a golf ball stopping at or near where it lands on a putting surface rather than having excessive backspin or forward movement upon landing.

However, this type of club face surface is quickly worn away by repeated ball contact, quickly reducing its ability to apply the gripping action to produce the backspin as originally intended. This requires that a golfer must have a particular club, for example a wedge or sand wedge, replaced or refinished in order to regain the original qualities.

Traditionally horizontal grooves are used on the club faces of conventional iron type club heads to produce backspin thereby providing the gripping action necessary to stop a golf ball on a putting surface. Generally such grooves are V-shaped or U-shaped and are symmetrically formed perpendicular to the club face. Punch marks have also been used on various designs for both iron and wood type club heads. Punch marks are often used in combination with other groove structures. Examples are shown in U.S. Pat. No. D-101,108 to Ellingham, and U.S. Pat. Nos. D-190,034, D-190,430 and D-192,366 to Penna.

SUMMARY OF THE INVENTION

The present invention uniquely combines the use of punch marks and grooves on the ball striking face of iron and wood type club heads. The use of punch marks of the ball striking face provides more available mass closer to the precise point where ball contact occurs. This construction creates greater energy transfer at the precise point of ball contact resulting in an unusually solid interaction between the ball and the club face resulting in greater feel being transmitted back to the golfer.

The present invention uses punch marks which are wider and deeper than standard grooves and are symmetrically formed with respect to an axis perpendicular to the ball striking face and also punch marks which are angularly oriented into the ball striking face at an upward or downward angular orientation.

In preferred embodiments, arrays of punch marks in various geometrical configurations are located proximate the center of the ball striking face of the golf club and surrounded by a series of hyphenated vertical grooves to enhance energy transfer and greater gripping action from the curved edges of the punch marks to a golf ball when it is struck by the club head of the invention. Other embodiments contemplate the use of horizontal grooves, both continuous and hyphenated, in combination with a punch mark array. Still other embodiments contemplate the use of punch marks which are disposed at an angle with respect to the ball striking face providing greater gripping action because of the angled and curved edges of the marks.

The present invention uses punch mark arrays in combination with various groove configurations on wood and metal wood type golf club heads.

Among the objects of the present invention are the provision of a ball striking face configuration which imparts greater energy to a golf ball during the execution of a golf swing.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figures 1, 2, 3, 4, 5:
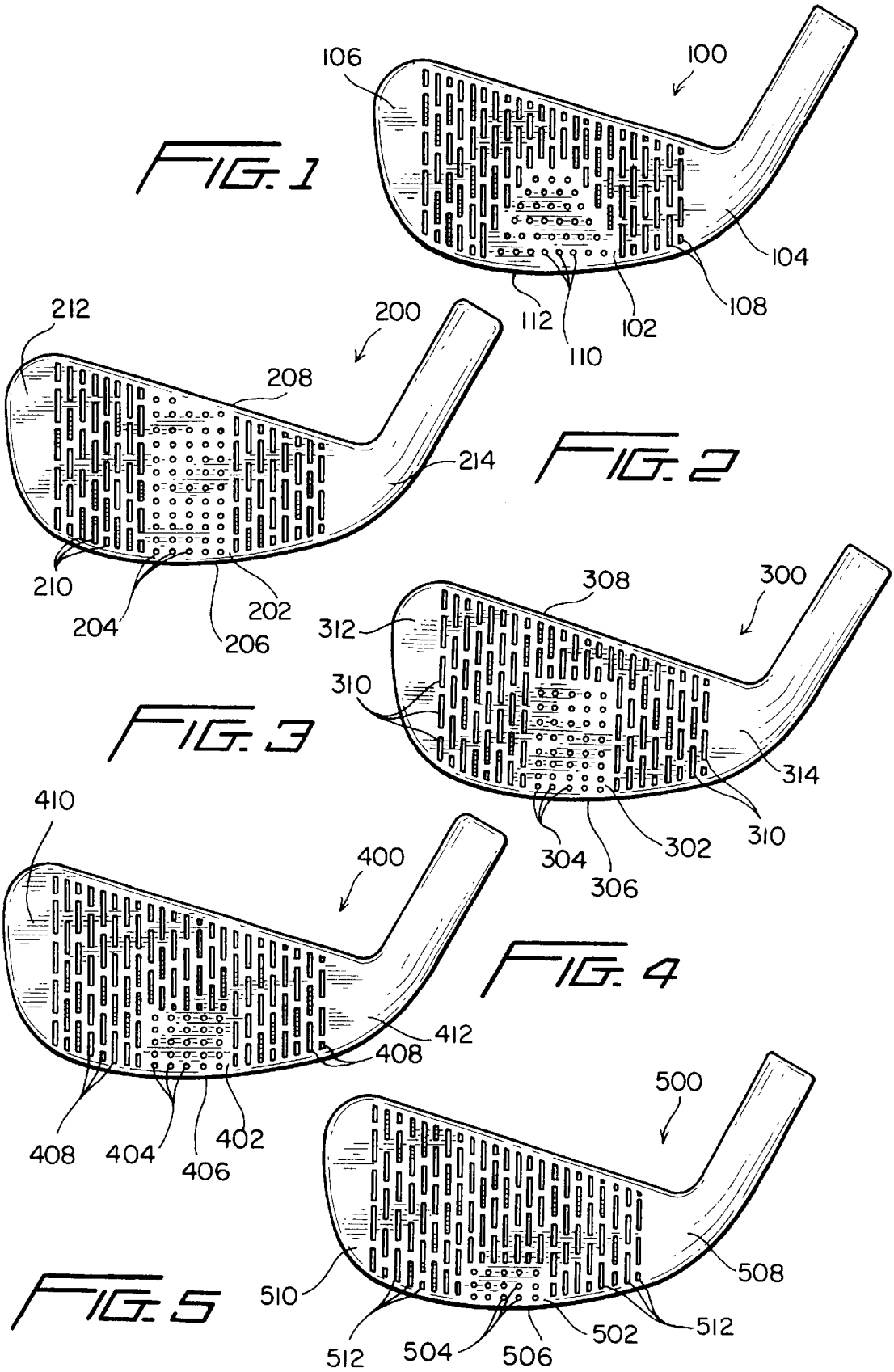
FIG. 1 shows a first embodiment of an iron type golf club head in accordance with the present invention.
FIG. 2 shows a second embodiment of an iron type golf club head in accordance with the present invention.
FIG. 3 shows a third embodiment of an iron type golf club head in accordance with the present invention.
FIG. 4 shows a fourth embodiment of an iron type golf club head in accordance with the present invention.
FIG. 5 shows a fifth embodiment of an iron type golf club head in accordance with the present invention.

FIG. 1 illustrates a front elevational view of an iron type golf club head 100 in accordance with the present invention.

The club head 100 is conventional in design and includes a ball striking face 102, heel 104 and toe 106. The club face 102 is provided with a series of vertical hyphenated grooves 108 and a centrally located trapezoidal array of punch marks 110 having a lowest edge adjacent the bottom edge 112 of the club head 100.

FIG. 2 shows an iron type golf head 200 having a ball striking face 202, an array of punch marks 204 centrally located and extending between the bottom edge 206 and top ridge 208 of the club head 200. Vertical hyphenated grooves 210 are located on either side of the punch mark array 204 adjacent the toe 212 and heel 214 of the club head 200 respectively.

FIG. 3 shows an iron type golf head 300 having a ball striking face 302, a rectangular array of punch marks 304 centrally located and extending upwardly from the bottom edge 306 of the club head 300. The rectangular array 304 extends between the bottom edge 306 and a top edge 308 of the club head 300. Vertical hyphenated grooves 310 are located on either side of the punch mark array 304 adjacent the toe 312 and heel 314.

FIG. 4 shows an iron type golf head 400 having a ball striking face 402, a square array of punch marks 404 centrally located and extending from the bottom edge 406 of the club head 400. Vertical hyphenated grooves 408 are located on either side of the punch mark array 404 adjacent the toe 410 and heel 412 of the club head 400.

FIG. 5 shows an iron type golf head 500 having a ball striking face 502, a small rectangular array of punch marks 504 centrally located and extending between the bottom edge 506 of the club head 500, in a heel 508 to toe 510 direction. Vertical hyphenated grooves 512 are located on either side of the punch mark array 504 adjacent the toe 510 and heel 508 of the club head 500 respectively.

Figure 6:
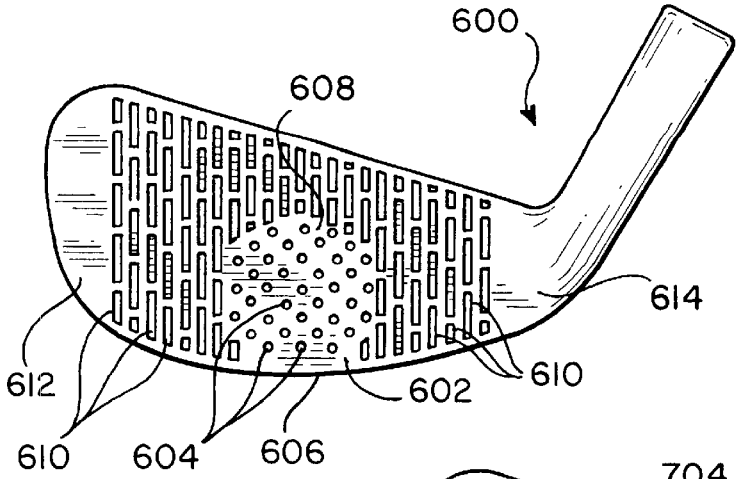
FIG. 6 shows a sixth embodiment of an iron type golf club head in accordance with the present invention.

FIG. 6 shows a sixth embodiment of an iron type golf head 600 having a ball striking face 602, a round array of punch marks 604 centrally located and extending between the bottom edge 606 upwardly toward a center region 608 of the club head 600. Vertical hyphenated grooves 610 are located on either side of and above the punch mark array 604 adjacent the toe 612 and heel 614 of the club head 600 respectively.

Figure 7:
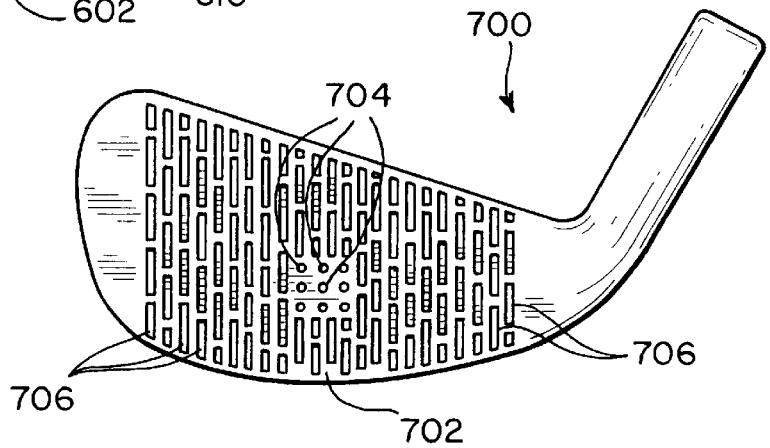
FIG. 7 shows a seventh embodiment of an iron type golf club head in accordance with the present invention.

FIG. 7 shows a seventh embodiment of an iron type golf head 700 having a ball striking face 702, a centrally located square array of punch marks 704. Vertical hyphenated grooves 706 are located surrounding the punch mark array 704 on the club face 702.

Figure 8:
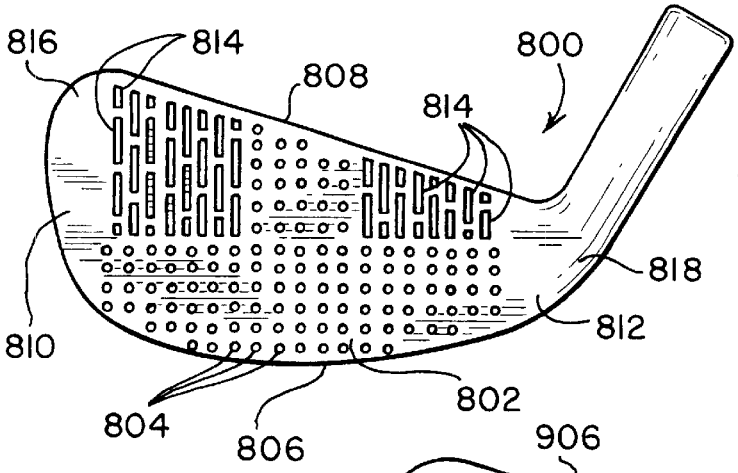
FIG. 8 shows an eighth embodiment of an iron type golf club head in accordance with the present invention.

FIG. 8 shows a eighth embodiment of an iron type golf head 800 having a ball striking face 802, an array of punch marks 804 centrally located and extending between the bottom edge 806 upwardly toward a top edge 808 and between the toe 810 and heel 812 of the club head 800. Vertical hyphenated grooves 814 are located on either side and above of the punch mark array 804 adjacent the toe 816 and heel 818 of the club head 800.

Figure 9:
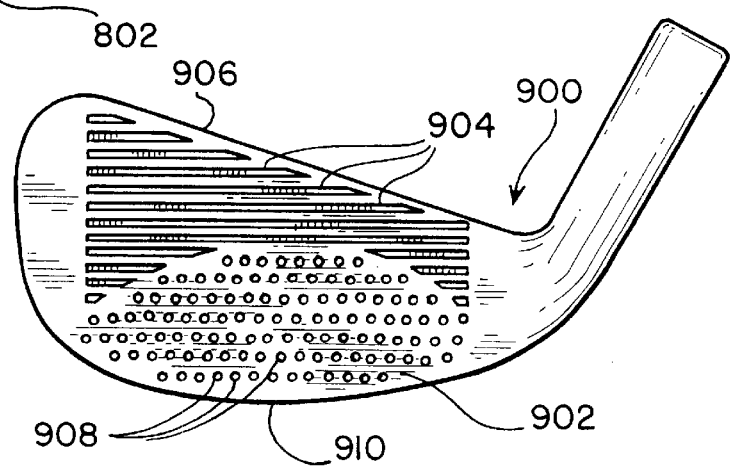
FIG. 9 shows a ninth embodiment of an iron type golf club head in accordance with the present invention.

FIG. 9 shows a ninth embodiment of an iron type golf club head 900 in accordance with the present invention. A ball striking face 902 includes a series of horizontal grooves 904 located near the upper surface 906 of the club head 900 and a semi-circular array of punch marks 908 located adjacent the bottom 910 of the club head 900.

Figure 10:
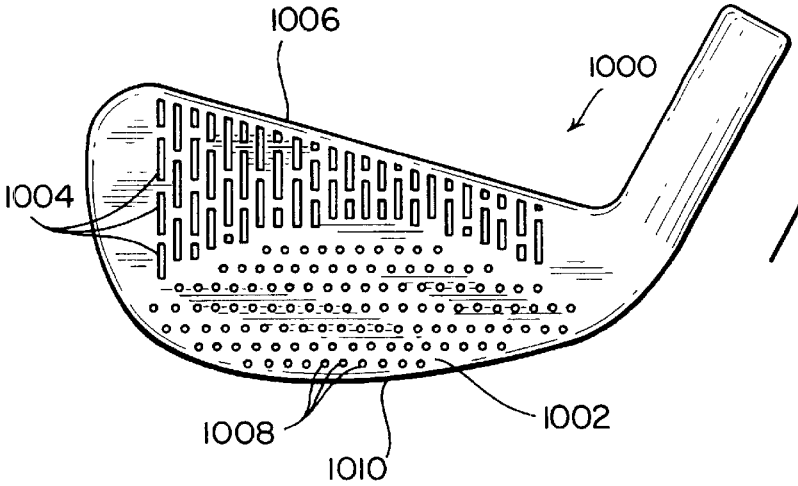
FIG. 10 shows a tenth embodiment of an iron type golf club head in accordance with the present invention.

FIG. 10 shows a tenth embodiment of an iron type golf club head 1000 in accordance with the present invention. A ball striking face 1002 includes a series of vertically hyphenated grooves 1004 located near the upper surface 1006 of the club head 1000 and a semi-circular array of punch marks 1008 located adjacent the bottom 1010 of the club head 1000.

Figure 11:
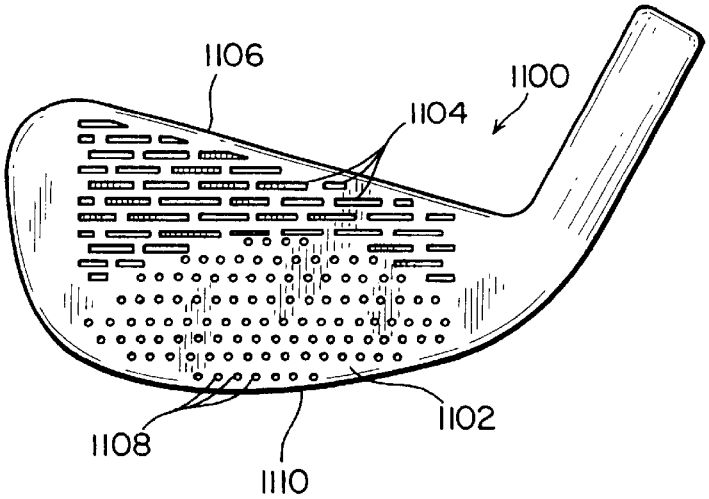
FIG. 11 shows a eleventh embodiment of an iron type golf club head in accordance with the present invention.

FIG. 11 shows a eleventh embodiment of an iron type golf club head 1100 in accordance with the present invention. A ball striking face 1102 includes a series of hyphenated horizontal grooves 1104 located near the upper surface 1106 of the club head 1100 and a semi-circular array of punch marks 1108 located adjacent the bottom 1110 of the club head.

Figure 12:
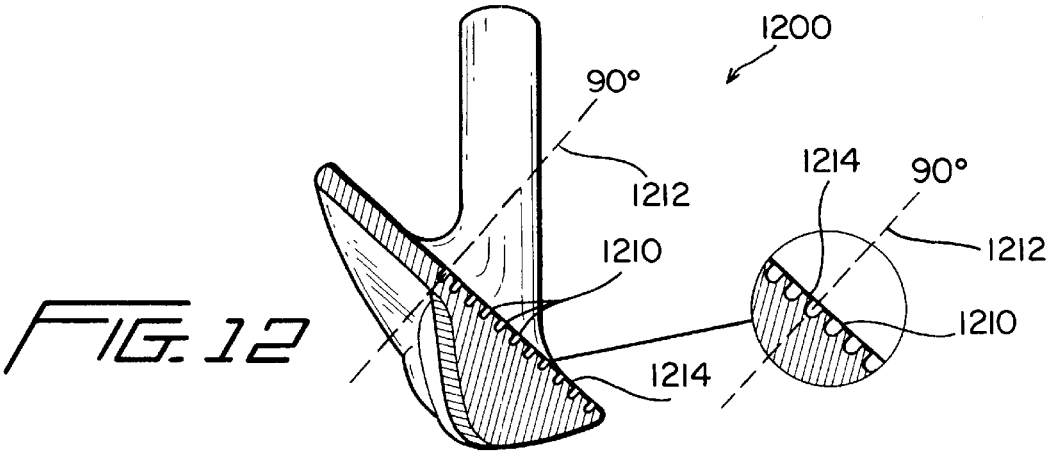
FIG. 12 is a partial is sectional view of a twelfth the present invention.

Further in accordance with the present invention. The punch marks may be cut into the ball striking face of a club so as to be symmetrical about an axis perpendicular to the face or at an angle therewith. For example, FIG. 12 illustrates a cross section an iron type golf club head 1200 wherein a series of punch marks 1210 are generally symmetrical about an axis 1212 perpendicular to the ball striking face 1214 at 90 degrees.

Figure 13:
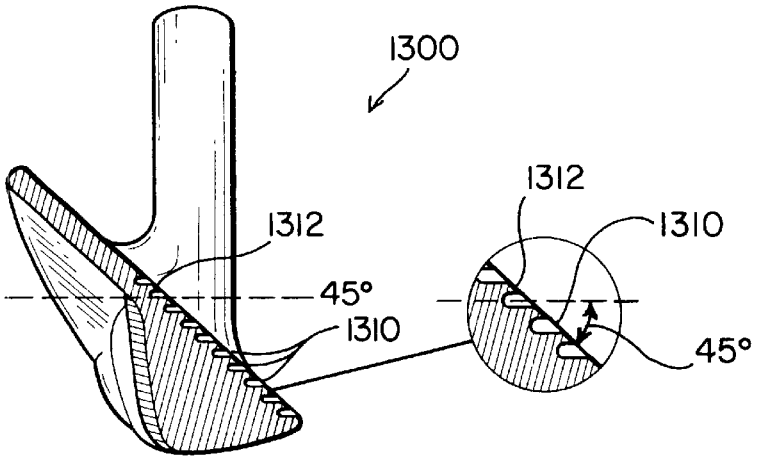
FIG. 13 is a sectional view of a thirteenth embodiment of the present invention.

FIG. 13 is a sectional view of another iron type golf club head 1300 wherein a series of punch marks 1310 are disposed downwardly at an angle of approximately 45° with the club face 1312.

Figure 14:
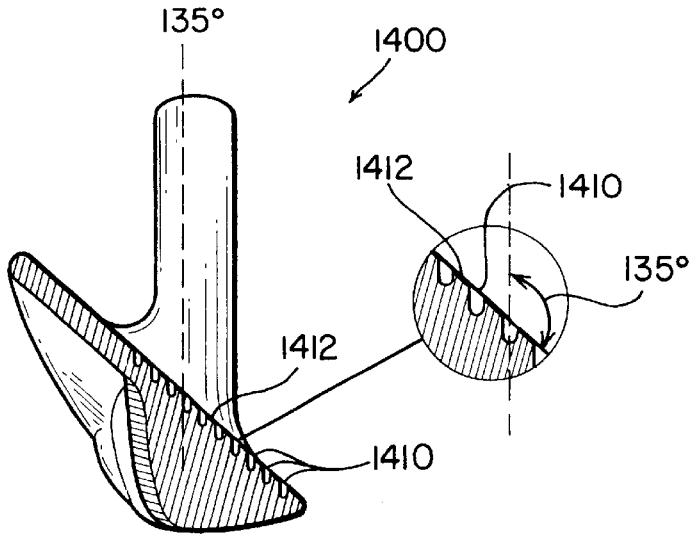
FIG. 14 is a sectional view of a fourteenth embodiment of the present invention.

FIG. 14 shows an iron type golf club 1400 having punch marks 1410 disposed upwardly at an angle of approximately 135° with the club face 1412.

Figure 15:
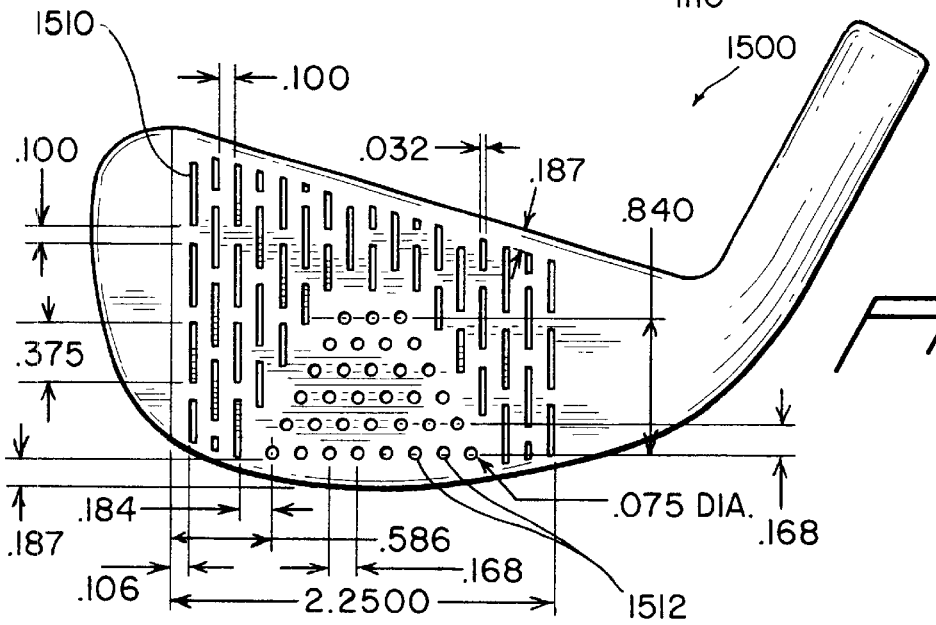
FIG. 15 is a view of a typical iron type golf club head in accordance with the present invention.

FIG. 15 illustrates an iron type golf head 1500 showing various dimensions for a series of hyphenated vertical grooves 1510 and punch marks 1512 on the ball striking face 1514 in the same general configuration as FIG. 1. In this embodiment the punch marks 1512 are 0.075 inches in diameter, approximately 0.030 inch in depth and are spaced at least 0.168 inch from center to center. The vertical grooves 1510 are spaced 0.100 inch apart and do not exceed 0.032 inch in width or 0.018 inch in depth. Preferably the vertical grooves 1510 are 0.375 inch long and are spaced from each other in a vertical row by 0.100 inch with horizontal opposing ends spaced also 0.100 inch apart, thus creating the hyphenated effect.

Figure 16:
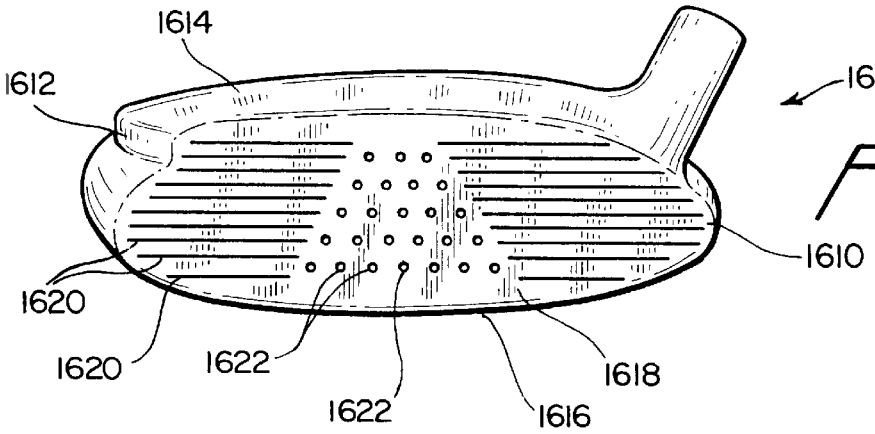
FIG. 16 is a first embodiment of a wood type golf club head in accordance with the present invention.

FIG. 16 shows a wood type golf club head 1600 having a heel 1610, toe 1612, upper surface 1614, bottom edge 1616, and a ball striking face 1618 having a face configuration including a series of rows of horizontal grooves 1620 extending between said heel and said toe in combination with an array of centrally located punch marks 1622.

Figure 17:
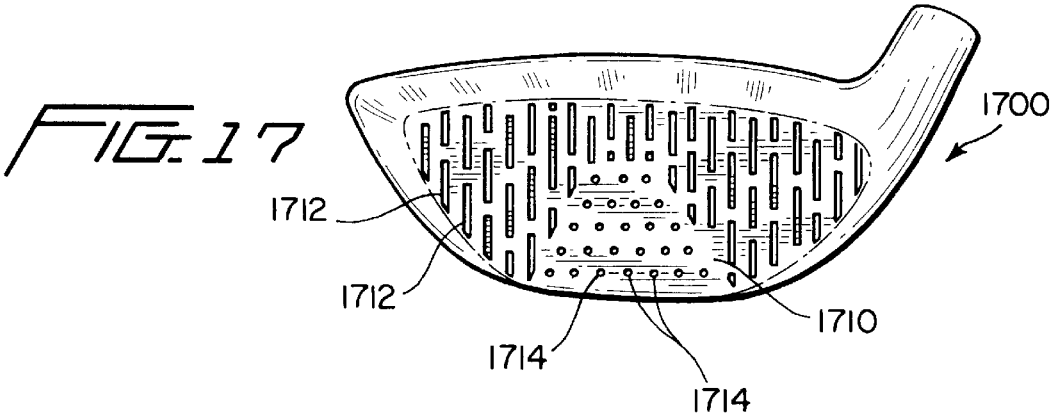
FIG. 17 is a second embodiment of a wood type golf club head in accordance with the present invention.

FIG. 17 shows a wood type golf club head 1700 having a ball striking face 1710 having a face configuration including a series of columns of vertical hyphenated grooves 1712 in combination with an array of centrally located punch marks 1714.

Figure 18:
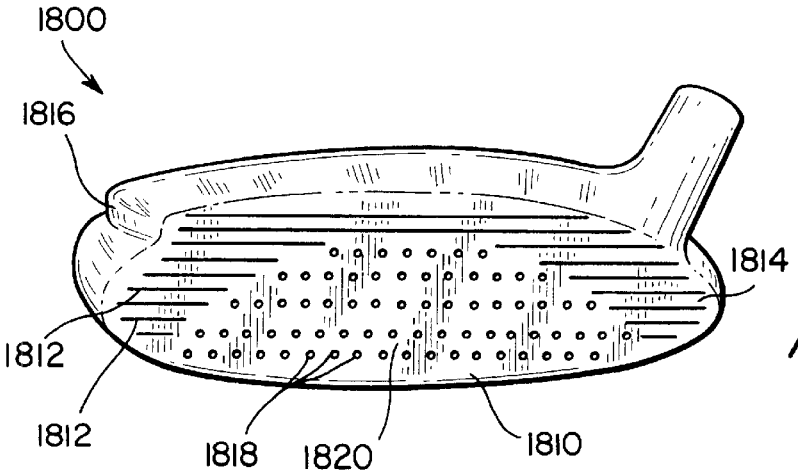
FIG. 18 is a third embodiment of a wood type golf club head in accordance with the present invention.

FIG. 18 shows a wood type golf club head 1800 having a ball striking face 1810 including a series of rows of horizontal grooves 1812 extending between the heel 1814 and the toe 1816 in combination with a semi-circular array of centrally located punch marks 1818 extending upwardly from a bottom edge 1820 of the club head 1800.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An iron type golf club head having a heel, toe, upper edge, bottom edge, and ball striking face, wherein the improvement comprises:

a ball striking face configuration including a series of columns of hyphenated vertical grooves in combination with an array of centrally located punch marks, said punch marks having outer gripping edges coincident with said ball striking face; said punch marks extending inwardly from said ball striking face about an axis at an angular orientation to said ball striking face, said axis being in a downward direction toward said ball striking face.

2. The golf club head of claim 1 wherein said axis has an angular orientation of less than 90 degrees with respect to said ball striking face.

3. The club head of claim 1 wherein said columns of hyphenated vertical grooves are parallel each to the other and extend between said upper edge and said bottom edge.

4. The iron type golf club head of claim 1 wherein said punch marks form a trapezoidal shape array.

5. The iron type golf club head of claim 1 wherein said punch marks are 0.075 inch, or less, in diameter, approximately 0.030 inch in depth and are spaced at least 0.168 inch between centers.

6. The iron type golf club head of claim 1 wherein said punch marks extend upwardly from said bottom edge in an array with a rectangular shape.

7. The iron type golf club head of claim 1 wherein said punch marks extend upwardly from said bottom edge in an array with a square shape.

8. The iron type golf club head of claim 1 wherein said punch marks extend upwardly from said bottom edge in an array with a semi-circular shape.

9. The iron type golf club head of claim 1 wherein said punch marks extend upwardly from said bottom edge in an array with a round shape.

10. The iron type golf club head of claim 1 wherein said punch marks are centrally located between said upper edge and said bottom edge and between said heel and said toe.

11. The iron type golf club head of claim 1 wherein said punch marks form an array with a square shape.

12. The iron type golf club head of claim 1 wherein said punch marks extend between said heel and said toe and extend upwardly from said bottom edge to said upper edge.

13. The iron type golf club head of claim 1 wherein said punch marks are disposed at an angle of ninety degrees with respect to said ball striking face.

14. The iron type golf club head of claim 1 wherein said punch marks are disposed at an angle of less than ninety degrees with respect to said ball striking face.

15. The iron type golf club head of claim 1 wherein said punch marks are disposed at an angle greater than ninety degrees with respect to said ball striking face.

16. The iron type golf club head of claim 1 wherein said punch marks are disposed toward said upper edge.

17. The iron type golf club head of claim 1 wherein said punch marks are disposed toward said bottom edge.

18. An iron type golf club head having a heel, toe, upper edge, bottom edge, and ball striking face wherein the improvement comprises:

a ball striking face configuration with an array of centrally located punch marks; said punch marks having outer gripping edges coincident with said ball striking face; said punch marks extending inwardly from said ball striking face about an axis at an angular orientation to said ball striking face, said axis being in an upward direction toward said ball striking face.

19. The golf club head of claim 18 wherein said axis has an angular orientation of greater than 90 degrees with respect to said ball striking face.

20. The club head of claim 18 further including a series of columns of hyphenated vertical grooves surrounding said punch marks on said ball striking face.

21. An iron type golf club head having a heel, toe, upper edge, bottom edge, and ball striking face wherein the improvement comprises:

a ball striking face configuration with an array of centrally located punch marks; said punch marks having outer gripping edges coincident with said ball striking face; said punch marks extending inwardly from said ball striking face; and a series of columns of hyphenated vertical grooves surrounding said punch marks on said ball striking face; said columns of hyphenated vertical grooves, if extended, are non-intersecting with other grooves on said club face; said columns of hyphenated vertical grooves oriented parallel, each to the other, and extending between said upper edge and said bottom edge of said club face.

* * * * *